US005161710A

United States Patent [19]

Chumley

[11] Patent Number: 5,161,710

[45] Date of Patent: Nov. 10, 1992

[54] CONTAINER WITH INTEGRALLY FORMED HANDLE

[75] Inventor: Dexter W. Chumley, Hartville, Ohio

[73] Assignee: Vaughan's Seed Company, Downers Grove, Ill.

[21] Appl. No.: 749,862

[22] Filed: Aug. 26, 1991

[51] Int. Cl.[5] ..... B65D 25/28

[52] U.S. Cl. ..... 220/754; 220/771; 206/203; 206/428

[58] Field of Search ..... 206/141, 142, 162, 203, 206/428; 383/14, 15; 229/117.12; 220/94 R, 94 A, 94 B

[56] References Cited

U.S. PATENT DOCUMENTS

| | | | |
|---|---|---|---|
| 2,051,940 | 8/1936 | Chichester | 383/14 |
| 2,784,756 | 3/1957 | Resnick | 383/15 |
| 3,184,148 | 5/1965 | Poupitch | 206/203 |
| 3,232,422 | 2/1966 | Whyte | 206/428 |
| 3,262,283 | 7/1966 | Taylor | 383/15 |
| 3,310,088 | 3/1967 | Hilderbrandt et al. | 220/90 A |
| 3,341,245 | 9/1967 | Wolford | 220/90 A |
| 3,473,703 | 10/1969 | Lippincott | 220/90 A |
| 3,528,471 | 9/1970 | Hartmann | 383/15 |
| 3,707,806 | 1/1973 | Toews et al. | 220/94 B |
| 3,842,976 | 10/1974 | Dea | 206/203 |
| 3,889,732 | 6/1975 | Wilkins | 220/94 A |
| 3,923,155 | 12/1975 | Tanzer | 206/141 |
| 4,715,495 | 12/1987 | Henry | 220/94 A |
| 4,763,833 | 8/1988 | Stoll | 229/117.12 |

FOREIGN PATENT DOCUMENTS

| | | | |
|---|---|---|---|
| 2632273 | 12/1989 | France | 229/117.12 |
| 268460 | 8/1950 | Switzerland | 229/117.12 |
| 257908 | 4/1969 | Switzerland | 229/117.12 |
| 736912 | 9/1955 | United Kingdom | 220/90 A |

*Primary Examiner*—David T. Fidei

*Attorney, Agent, or Firm*—Renner, Kenner, Greive, Bobak, Taylor & Weber

[57] ABSTRACT

A container is provided having a base, a wall portion extending from the base and defining a receptacle area, and a rim defining an opening into the receptacle area. The container comprises first and second opposing flange portions contiguous with the rim, and each flange portion has a first end affixed to the rim, a second end free or freeable from the rim, and a flexible laterally extending portion therebetween. A connector is provided to connect the second ends of the flanges together. A process is also provided for forming such a container and includes integrally forming the container components and scoring the material between the flanges and the rim such that the flanges are freed or rendered freeable from the rim.

9 Claims, 2 Drawing Sheets

CONTAINER WITH INTEGRALLY FORMED HANDLE

TECHNICAL FIELD

This invention relates to a container having an integrally formed handle. More particularly, the invention relates to container having at least two flexible flanges which are each connected at one end to the container, and which have a second end free or freeable from the container and which may be connected to each other to form an integral handle.

BACKGROUND OF THE INVENTION

The present invention has particular applicability to the commercial nursery and greenhouse industries, wherein it has been known to supply trays or "flats" for planting seedlings and the like. Each flat includes one or more inserts or "packs" which actually hold the plant. Each pack includes a plurality of individual, arranged cells, wherein each cell is a cup or receptacle. Each cell may be filled with soil and used to hold a plant or seedling. A pack is often purchased by the consumer who wishes the number of plants in the given pack.

For the consumer who visits a nursery or greenhouse, it is often desired to purchase a number of packs of a variety of plants. The packs are most often arranged in even rows and the consumer is encouraged to browse and select a pack of plants which meets the needs of the particular gardening application. For even the average sized gardening project, this often requires more than one pack.

Packs may be easily produced in large quantities by thermoforming or the like, and are usually regarded by the industry as being a useful item of short-term or even disposable service life.

It is known to provide packs which have a relatively thin wall and base construction as opposed to a stronger upper surface and rim portion. In this way, it is possible to more easily remove a plant from an individual cell by pushing the base and lower wall toward the rim portion and exposing the root ball of the plant.

Furthermore, it has also been found that if the individual cell is first removed from a pack, then the detached cell itself can be turned upside down to aid in removal of the plant. The portions of the packs between each cell, while possibly being stiffer or stronger than the bottom wall and base portions of the cell, are often made to be either removed, cut or broken. Unfortunately, when a pack is potted with a number of plants, the thin material between the cells is often not sufficient to support the entire weight of the cells. It is not possible in that circumstance to simply grasp one side of the pack and pick it up, because the pack is prone to collapse under its own weight combined with that of the plants.

The attachment of handles to the pack so as to evenly distribute weight throughout the structure has been employed with generally successful results. However, these handles have adversely impacted usefulness, ease of production and cost of such packs.

For example, it has been known to provide a slot and bit connector, wherein the pack is provided with a narrow slot into which a bit at the end of a handle is inserted and then twisted. By being twisted with respect to the slot, the bit is prevented from being removed from the slot, and hence the handle may be used to pick up the pack. Often, the handle has two bits for engaging two slots.

For the gardening industry professional as well as for the average consumer, and for many applications wherein it is necessary to move a container, a need exists for a container having an integral handle which is useful for carrying the container and which is cost effective to manufacture.

SUMMARY OF INVENTION

It is therefore, an object of the present invention to provide a container having an integral handle.

It is another object of the present invention to provide a container as above which is easy to use and to manufacture.

It is yet another object of the present invention to provide a container as above which may be formed using conventional techniques such as thermoforming.

It is still another object to provide a process for making a container having an integral handle.

At least one or more of the foregoing objects, together with the advantages thereof over the known art relating to containers, which shall become apparent from the specification which follows, are accomplished by the invention as hereinafter described and claimed.

In general, the present invention provides a container having a base, a wall portion extending from the base and defining a receptacle area, and a rim defining an opening into the receptacle area, wherein the container comprises first and second opposing flange portions contiguous with the rim. Each flange portion is provided with a first end affixed to the rim, a second end free or freeable from the rim, and a flexible laterally extending portion therebetween. There is also provided means to connect the second ends of the flanges together.

The present invention also includes a process for making a container having an integral handle, which comprises the steps of integrally forming at least one base, a wall portion extending from the base and defining a receptacle area, a rim defining an opening into the receptacle area, and first and second flanges contiguous with the rim and having first and second ends and a laterally extending portion therebetween; and, making a score line in a portion of the container short of the first ends of the flanges and between the flanges and the rim, such that the second ends of the flanges are free or freeable from the rim.

PREFERRED EMBODIMENT FOR CARRYING OUT THE INVENTION

Figure 1:
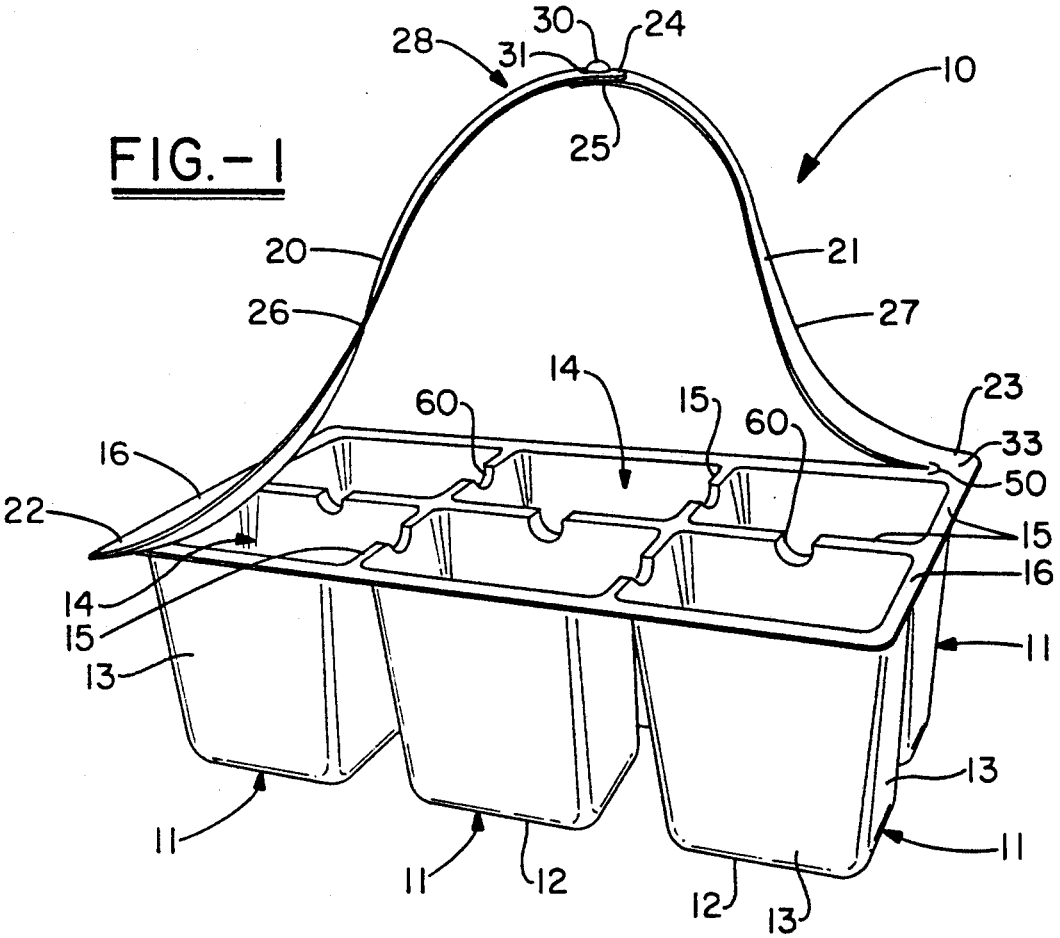
FIG. 1 is a perspective view of a container according to the present invention having a number of arranged cells and showing the integral handle in position for carrying the container.

A container having an integral handle is generally depicted by the numeral 10 on the attached drawings. As shown in FIG. 1, container 10 may be provided with a number of individual receptacle cells 11, such as may be useful to contain soil in which a seedling is planted. Container 10 is known in the industry as a "handle pack". Cells 11 are regularly spaced in rows in the generally rectangular container 10.

As will be appreciated by one skilled in the art, the invention has equal application to a receptacle without individual cells, such as may be desired for planting larger plants. The invention also has application to a container having any number of cells arranged in any regular or even irregular pattern, and to a container which is round, square or any of a variety of shapes. For purposes of this disclosure and ease of description, the invention will be described with respect to container 10 having a plurality of cells 11, as would be termed a "handle pack" in the gardening and nursery industries.

Preferably, container 10 is thermoformed from a suitable plastic material such as a polystyrene or the like, with all parts of the container 10 formed during the thermoforming operation. However, other techniques which are known in the art may be employed to fabricate the container according to the present invention.

Container 10 is provided with at least one cell 11. Cell 11 has a base 12 and at least one wall portion 13 extending from base 12 and defining an open receptacle area generally designated by the numeral 14. Each cell 11 of the embodiment of the invention depicted in FIG. 1 is provided with four converging wall portions 13. It is to be appreciated that the number of wall portions are not a limitation of the invention. By way of example, a cone shaped cell (not depicted) would have only one continuous wall portion extending from base 12, which base 12 may even converge to a point. This cone shaped cell would be within the scope of the invention, as would other configurations.

Receptacle area 14 may be filled with soil into which a seedling is planted, or in which objects may be carried such as for a sorting operation or the like.

Each cell 11 is provided with a rim 15 which defines the opening into receptacle area 14. Furthermore, a continuous outer rim 16 may also be provided for container 10 having a plurality of cells 11, which outer rim 16 preferably surrounds all cells 11. By "continuous" it is meant that outer rim 16 is configured so as to substantially encompass all cells 11. Rim 15 of a given cell 11 may be thought of as contiguously merging into outer rim 16, such that both are merely extensions of the same surface area. In the case of a container having only one receptacle area 14, (not shown) only outer rim 16 would be necessary.

A first flange 20 and a second flange 21 are provided as an extension from outer rim 16. Flanges 20 and 21 are provided with a first end 22 and 23 respectively, and a second end 24 and 25 respectively. Furthermore, each flange 20 and 21 is also provided with a laterally extending portion 26 and 27 respectively. By the use of the word "end" for first ends 22, 23 and second ends 24, 25, it is understood to mean some portion along a given flange 20 or 21, and not necessarily the furthermost point thereof. By use of the word "laterally extending portion" it is understood to mean a length of flange 20 or 21 between the first and second ends of the flange. The actual length or width of first ends 22, 23 and second ends 24, 25, as well as laterally extending portions 26, 27 are not an absolute limitation of the invention, and will vary depending upon the overall size of container 10, the material used to form container 10, and the like, all of which may vary and still remain within the scope of the invention. The length requirements of flanges 20 and 21 will be more fully addressed hereinbelow.

Preferably, each flange 20, 21 is thermoformed during the same thermoforming procedure as container 10, and are configured so as to be thin enough to be sufficiently flexible to allow second end 24 of flange 20 to be brought into contact with second end 25 of flange 21, as depicted in FIG. 1. By being formed from a material such as a thermoplastic, the given flange 20 or 21 may be made thin enough to be flexible and yet strong enough to withstand repeated flexing without failure. By "flex" it is preferred that the flanges 20 and 21 be capable of being bent at some point at their approximate mid section. Such bending of a flexible member such as flanges 20 and 21 will be understood by one skilled in the art.

By connecting second ends 24 and 25, a handle is effectively formed, and is generally indicated by the numeral 28 in FIG. 1. Handle 28 may be grasped so as to pick up and move or convey container 10. As stated hereinabove, it is necessary that flanges 20 and 21 be flexible enough so as to permit flexing sufficient to allow second ends 24 and 25 to be brought into contact.

Figure 4:
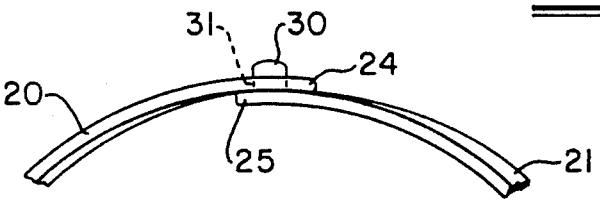
FIG. 4 is a greatly enlarged perspective view, partially broken away, of one portion of the handle shown in FIG. 1.

One of a variety of mechanisms for effecting connection of second ends 24 and 25 of flanges 20 and 21 is depicted in the drawings. A dimple or bulb 30 is provided proximate to end 25 of flange 21, and an aperture 31 is provided in second end 24 of flange 20. The outside diameter of dimple 30 and the inside diameter of aperture 31 are configured such that dimple 30 may be inserted into aperture 31 (FIG. 4) effecting a friction fit of sufficient strength to prevent dimple 30 from disengaging from aperture 31 without additional force being applied to dimple 30 to force it out of aperture 31.

Figure 2:
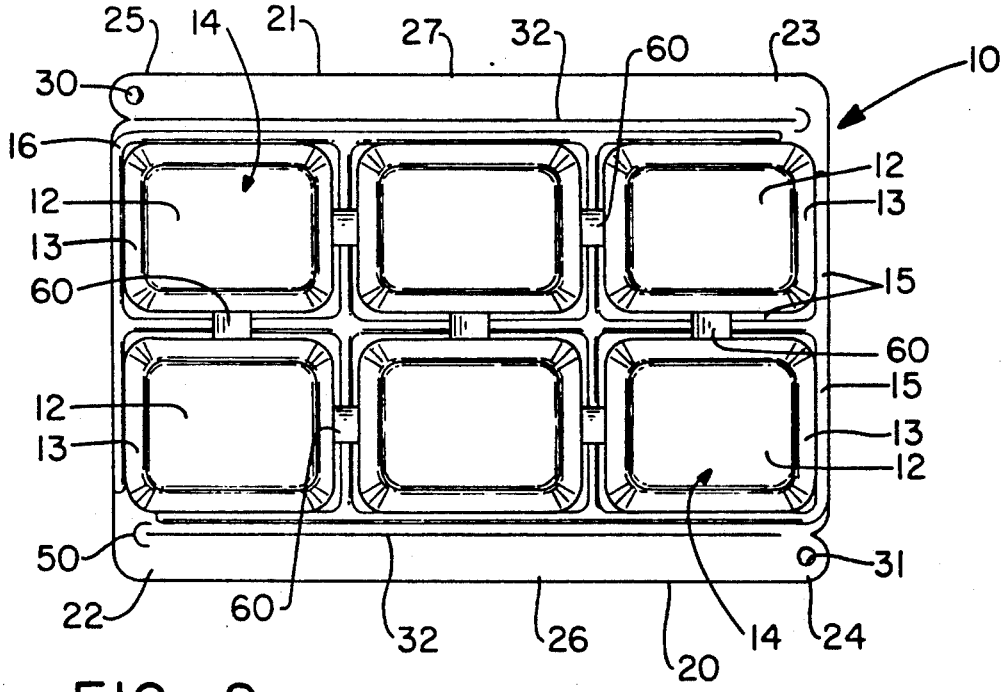
FIG. 2 is a top plan view of the container in FIG. 1, without the handle in position for carrying the container.
Figure 3:
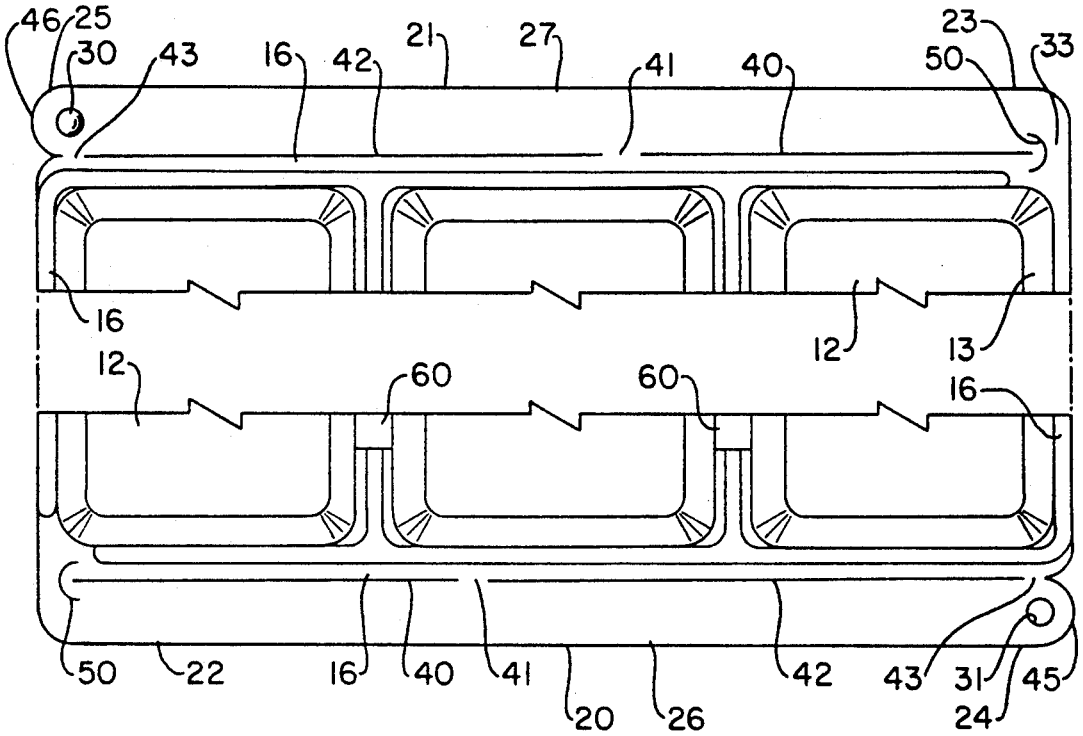
FIG. 3 is a partially broken away view of one portion of the container of FIG. 2 showing the detail of the flange portions of the invention.

As stated hereinabove, flanges 20 and 21 may be thermoformed or otherwise formed integrally with the other portions of container 10. When thus formed, flanges 20 and 21 may be merely an extension of outer rim 16 as shown in FIG. 3 with respect to flange 20. A score line 32 (FIG. 2) may be made between flanges 20 and 21 and outer rim 16 and along the laterally extending portions 26 and 27 such that flanges 20 and 21 may be freed from container 10. As depicted in FIG. 3 with respect to flange 21, a portion 33 of material between first end 23 of flange 21 and outer rim 16 is preferably left unscored such that the flanges 20 and 21 are not completely removable from container 10. With the score line 32 terminating short of first end 23, flanges 20 and 21 may be flexed while being affixed and anchored to container 10 by the integral connection of first ends 22 and 23 thereto (FIG. 1). A similar score line may be made with respect to flange 20.

By "score" it is understood to mean a partial depth cut in the material or equally, a cut completely through the material between the flanges 21 and 22 and rim 16. If the material is completely cut, then the flange is free from container 10 and may be flexed so as to effect contact of second ends 24 and 25. If the score line is not completely cut through the container material, the end user may grasp a flange 20 or 21 and break or cut the remaining material so as to free the flange, in which case the portion of flange 20 or 21 adjacent the score line is said to be "freeable" or removable from the container. By "freeable" used herein, a flange 20 or 21 is attached to container 10 at rim 16 in a manner so as to permit its removal or to permit removal of a portion thereof from rim 16.

It is understood that the preferred embodiment of the invention would have diagonally opposed first ends 22 and 23 of each flange 20 and 21 affixed to container 10, such that only a portion of each flange, such as laterally extending portions 26 and 27 and second ends 24 and 25 would be free or freeable from container 10. The length of a flange 20 or 21 free of freeable is not critical, except that a sufficient length must be ultimately freed or removed so that the flanges 20 and 21 are of sufficient length to allow flexing and contact of second ends 24 and 25 without fracture or other failure of flange 20 or 21. The required length of flanges 20 and 21 thus freed will be readily ascertainable by one skilled in the art based upon the other elements of container 10 such as its size, shape and material of construction, as was discussed hereinabove.

Another means of effecting a freeable flange 20 or 21 is to provide partial scoring along the lateral length of flanges 20 and 21, such that some material of container 10 remains intact between flanges 20, 21 and rim 16. As shown in FIG. 3, a first score line 40 is made from a location distal to first end 23 of flange 21 to a first breakaway tab 41, while a second score line 42 is made distal to first breakaway tab 41. Second score line 42 may be made to second end 25 of the flange 20 or 21 or it may terminate some distance short of second end 25, thus forming a second breakaway tab 43. Score lines 40 and 42 are thus configured so as to be linear, juxtaposed and not in contact with each other, and score line 42 may be said to be made to a point some distance short of the outer ends 45 or 46 of second ends 24 or 25 respectively.

When breakaway tabs 41 and 43 are employed, it is preferred that the score lines 41 and 42 be a cut completely through the material of container 10, such that a user need only break the relatively small amount of remaining material connecting flange 20 or 21 to rim 16 in order to free the associated flange. Of course, the breakaway tabs may be configured such that they must be cut in order to free flanges 20 and 21, which would still be within the scope of the invention. The length of each score line such as score lines 40 and 42, as well as the length of tabs 41 and 43 are not critical, and one skilled in the art will readily understand from the present disclosure how long each must be in order to provide tabs 41 and 43 which are strong enough to prevent flanges 20 and 21 from disengaging or being freed from container 10 during storage, shipping and the like, and yet which are small enough so as to allow a user to easily break or otherwise free flanges 20 and 21 from container 10.

It is also preferred that flanges 20 and 21 be affixed at first ends 22 and 23 on opposing sides of container 10, such that when integral handle 28 is formed by connecting second ends 24 and 25, and a user grasps handle 28 at the approximate location of connected seconds ends 24 and 25, the weight of container 10 is distributed evenly through handle 28 and to rim 16. It is possible of course, to provide container 10 with any number of flanges such as flanges 20 and 21, although at least two are required.

As best shown in FIG. 3, an isolating cut 50 may be provided in the contiguous material of container 10 between first end 23 of flanges 21 and rim 16. Isolating cut 50 is provided between first end 23 and score line 40 such that first end 23 is prevented from tearing away from container 10 when flange 21 is flexed to effect contact of second ends 24 and 25 and support the weight of the container 10 and its contents. Preferably, isolating cut 50 is arcuate or semicircular in shape so as to maximize the distribution of forces along the cut 50 and terminate or limit any tear.

Container 10 may also be provided with troughs 60 in rim 15 between cells 11. Troughs 60 allow water to drain or overflow from one cell 11 to the next.

Figure 5:
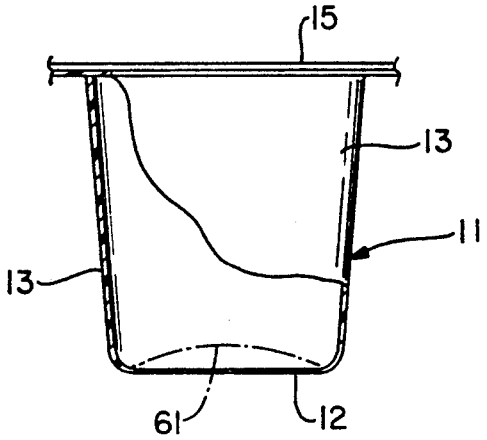
FIG. 5 is a side elevational view, partially broken away, of one cell of the container of FIG. 1.

Each cell 11 may also be provided with thin wall portions 13 in proximity to base 12 in order to facilitate pushing base 12 toward rim 15 to remove a plant (not shown) from cell 11. Base 12 may be provided with a domed portion 61 (FIG. 5) to further facilitate removal of a plant therefrom. The material of wall portion 13 may decrease in thickness at the lower portions thereof and proximate to domed portion 61, as shown in cross section in FIG. 5. This decrease in thickness also facilitates pushing material out of cell 11.

A process according to the present invention would include integrally forming at least one base 12, wall portion 13 extending from base 12 and defining receptacle area 14, rim 15, outer rim 16, and first and second flanges 20 and 21 having first ends 22 and 23, second ends 24 and 25, laterally extending portions 26 and 27 and dimples 30 and 31, as well as all of the elements of container 10 as discussed herein. The process also includes making a score line such as lines 32, 40 and 42, by any method known in the art, in a portion of container 10 between rim 16 and respective flanges 20 and 21 and without scoring the portion between first ends 22 and 23 and rim 16, such that second ends 24 and 25 are free or freeable from container 10. Score lines 32, 40 and 41 are made such that flanges 20 and 21 are free or freeable from outer rim 16.

Thus it should be evident that the device and process of the present invention are highly effective in forming a container having an integral handle for conveying materials. The invention is particularly suited for multi-celled flats for planted seedlings, but is not necessarily limited thereto.

Based upon the foregoing disclosure, it should now be apparent that the use of the container having an integral handle described herein will carry out the objects set forth hereinabove. It is, therefore, to be understood that any variations evident fall within the scope of the claimed invention and thus, the selection of specific component elements can be determined without departing from the spirit of the invention herein disclosed and described. Moreover, as noted hereinabove, other means for forming container 10 can be substituted for the thermoforming and scoring techniques described. Thus, the scope of the invention shall include all modifications and variations that may fall within the scope of the attached claims.

What is claimed is:

1. A rectangular container having a base, a wall portion extending from the base and defining a receptacle area, and a rim defining an opening into the receptacle area, the container comprising:

first and second opposing parallel flange portions contiguous with the rim;

each said flange portion having a first end affixed to the rim, a second end detachably affixed to the rim, and a flexible laterally extending portion therebetween, said first and second ends of said first flange portion being diagonally positioned with respect to corresponding first and second ends of said second flange portion; and means to connect said second ends of said flanges together.

2. A container, as set forth in claim 1, wherein the container comprises a thermoplastic material.

3. A container, as set forth in claim 1, further comprising a plurality of breakaway tabs detachably affixing said second ends of said flanges to the rim.

4. A container, as set forth in claim 1, further comprising an isolating cut in the rim in juxtaposition to, but spaced from each of said first ends of said flanges.

5. A container, as set forth in claim 4, wherein said isolating cut is an arcuate cut.

6. A container, as set forth in claim 1, wherein said means to connect said second ends of said flanges includes a dimple in one of said second ends and an aperture in the other said second end, such that when said dimple is placed into said aperture, a friction fit is formed therebetween, and a handle is formed by said flange portions extending diagonally across the container.

7. A container, as set forth in claim 1, wherein the container comprises a plurality of individual bases, wall portions, receptacle areas and rims defining a plurality of cells.

8. A container, as set forth in claim 7, further comprising a continuous outer rim bounding said plurality of said cells.

9. A container, as set forth in claim 8, wherein said flanges are contiguous with said continuous outer rim.

* * * * *